US007971956B2

(12) United States Patent
Zhang

(10) Patent No.: US 7,971,956 B2
(45) Date of Patent: Jul. 5, 2011

(54) LIQUID CONTAINER

(75) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1012 days.

(21) Appl. No.: 11/828,965

(22) Filed: Jul. 26, 2007

(65) Prior Publication Data

US 2008/0049078 A1 Feb. 28, 2008

(30) Foreign Application Priority Data

Jul. 28, 2006 (JP) ..... 2006-205539

(51) Int. Cl.
*B41J 29/393* (2006.01)
*B41J 29/38* (2006.01)
*B41J 2/175* (2006.01)

(52) U.S. Cl. ..... 347/19; 347/6; 347/84

(58) Field of Classification Search ..... 347/19
See application file for complete search history.

(56) References Cited

U.S. PATENT DOCUMENTS

2006/0170718 A1* 8/2006 Takahashi et al. ..... 347/7

FOREIGN PATENT DOCUMENTS

| | | |
|---|---|---|
| JP | 2003-039707 | 2/2003 |
| JP | 2004-306475 | 11/2004 |
| JP | 2006-088605 | 4/2006 |
| WO | 2005000591 A1 | 1/2005 |

* cited by examiner

*Primary Examiner* — Uyen-Chau N Le
*Assistant Examiner* — Kajli Prince
(74) *Attorney, Agent, or Firm* — Maschoff Gilmore & Israelsen

(57) ABSTRACT

Provided herein is a liquid container including a liquid containing portion for containing liquid; and a detection portion which outputs a detection signal having a frequency of about 1/odd number of a frequency of a detection signal output when the amount of liquid contained in the liquid containing portion is equal to or less than a predetermined amount, when the amount of liquid contained in the liquid containing portion is greater than the predetermined amount.

10 Claims, 8 Drawing Sheets

LIQUID CONTAINER

BACKGROUND

1. Technical Field

The present invention relates to a liquid container for containing liquid used in a liquid consuming apparatus.

2. Related Art

In a liquid consuming apparatus that consumes liquid, a technology for managing a liquid consumption amount is known. As a liquid consuming apparatus, for example, a printing apparatus which has one or a plurality of ink cartridges mounted therein and performs a printing process using ink is known. As a technology for managing an ink residual amount, a technology for determining whether the amount of ink contained in an ink cartridge is equal to or less than a predetermined ink amount using a piezoelectric sensor is known.

In the technology using the piezoelectric sensor, it is determined whether the amount of ink contained in the ink cartridge is equal to or less than a predetermined ink amount, on the basis of a difference between a frequency (Empty frequency) of a detection signal output from the piezoelectric sensor when the amount of ink contained in the ink cartridge is equal to or less than the predetermined amount and on the basis of a frequency (Full frequency) of a detection signal output from the piezoelectric sensor when the amount of ink contained in the ink cartridge is greater than the predetermined amount (see, for example, JP-A-2003-39707).

However, in the technology using the piezoelectric sensor, since a difference between a natural frequency of a vibration system in a case where ink is not contained in the vibration system and a natural frequency of a vibration system in a case where ink is contained in the vibration system is used, both natural frequencies are different from each other. Accordingly, since one natural resonance frequency (resonance frequency) cannot be detected in a driving signal having the other natural frequency, the driving signal having an Empty frequency and the detection signal having a Full frequency need to be used for detecting the detection signal having the Empty frequency and the detection signal having the Full frequency.

The detection signal may be detected with respect to only any one of the case where the ink is not contained in the vibration system and the case where the ink is contained in the vibration system such that it is determined whether the amount of ink contained in the ink cartridge is equal to or less than the predetermined amount. However, in this case, determination precision is low. For example, due to noise, when the detection signal having the Full frequency is used, the detection signal having the Full frequency may be obtained although the amount of ink contained in the ink cartridge is equal to or less than the predetermined amount. In this case, idle driving is performed and thus a print head may be damaged.

SUMMARY

An advantage of some aspects of the invention is that it provides a liquid container capable of determining whether the amount of liquid contained in the liquid container is equal to or less than a predetermined amount, using a single driving signal.

According to an aspect of the invention, there is provided a liquid container including a liquid containing portion for containing liquid; and a detection portion which outputs a detection signal having a frequency of about 1/odd number of a frequency of a detection signal output when the amount of liquid contained in the liquid containing portion is equal to or less than a predetermined amount, when the amount of liquid contained in the liquid containing portion is greater than the predetermined amount.

Since the liquid container includes the detection portion which, when the amount of liquid contained in the liquid containing portion is greater than the predetermined amount, outputs the detection signal having the frequency of about the 1/odd number of the frequency of the detection signal output when the amount of liquid contained in the liquid containing portion is equal to or less than the predetermined amount, it is possible to determine whether the amount contained in the liquid container is equal to or less than the predetermined amount, using a single driving signal.

The frequency f1 of the detection signal output when the amount of liquid contained in the liquid containing portion is greater than the predetermined amount and the frequency f2 of the detection signal output when the amount of liquid contained in the liquid containing portion is equal to or less than the predetermined amount may satisfy Equation A:

$$0.75*f2(1-0.25/B)/B \leqq f1 \leqq 1.25*f2(1-0.25/B)/B \qquad \text{Equation A}$$

where 0.25/B is a waveform margin and B is an odd number of 3 or less.

According to this configuration, it is possible to determine whether the amount of liquid contained in the liquid container is greater than the predetermined amount or is equal to or less than the predetermined amount, using the driving signal having the frequency f1.

The detection portion may include a communicating path which communicates with the liquid containing portion, is filled with the liquid when the amount of liquid contained in the liquid containing portion is greater than the predetermined amount, and is not filled with the liquid when the amount of liquid contained in the liquid containing portion is equal to or less than the predetermined amount; and a vibration detector which is provided in the communicating path and outputs the detection signal according to detected vibration. A natural resonance frequency of a vibration portion formed by the vibration detector and the communicating path when the communicating path is filled with the liquid may be about 1/odd number of a natural resonance frequency when the communicating path is not filled with the liquid.

According to this configuration, since the natural resonance frequency of the vibration portion formed by the vibration detector and the communicating path when the communicating path is filled with the liquid is about 1/odd number of the natural resonance frequency when the communicating path is not filled with the liquid, it is possible to determine whether the amount of liquid contained in the liquid container is equal to or less than the predetermined amount, using the driving signal having the frequency f1.

The natural resonance frequency f1 when the communicating path is filled with the liquid and the natural resonance frequency f2 when the communicating path is not filled with the liquid may satisfy Equation A:

$$0.75*f2(1-0.25/B)/B \leqq f1 \leqq 1.25*f2(1-0.25/B)/B \qquad \text{Equation A}$$

where 0.25/B is a waveform margin and B is an odd number of 3 or less.

According to this configuration, it is possible to determine whether the amount of liquid contained in the liquid container is greater than the predetermined amount or is equal to or less than the predetermined amount, using the driving signal having the frequency f1.

The natural resonance frequency f1 may be defined by Equation 1.

$$f_1 = \frac{1}{2\pi\sqrt{(M_{act} + M_s) \times (C_{act} + C_i)}} \quad \text{Equation 1}$$

The natural resonance frequency f2 may be defined by Equation 2:

$$f_2 = \frac{1}{2\pi\sqrt{M_{act} \times C_{act}}} \quad \text{Equation 2}$$

where Ms is inertance of the communicating path, Mact is inertance of the vibration detector, and Cact is compliance of the vibration detector. The communicating path and the vibration detector may satisfy Equation A. By this configuration, it is possible to determine whether the amount of liquid contained in the liquid container is equal to or less than the predetermined amount using a single driving signal, according to a vibration characteristic of the communicating path of the liquid container.

The liquid containing portion may include a first containing portion and a second containing portion, and the first containing portion and the second containing portion may be connected to each other via the communicating path. In this case, it is possible to change the amount of liquid which can be used after the amount of liquid contained in the liquid container is equal to or less than the predetermined amount, by adjusting the capacity of the second containing portion.

The communicating path may include a first communicating path which communicates with the first containing portion, a second communicating path which communicates with the second containing portion, and a third communicating path which communicates with the first and second communicating paths and has the vibration detector mounted therein. By this configuration, it is possible to suppress air bubbles from introduced into the third communicating path and to reduce detection error.

The natural resonance frequency f1 may be defined by Equation 3.

$$f_1 = \frac{1}{2\pi\sqrt{\left(M_{act} + \frac{M_{s1} \times M_{s2}}{M_{s1} + M_{s2}} + \frac{M_{s3}}{2}\right) \times (C_{act} + C_i)}} \quad \text{Equation 3}$$

The natural resonance frequency f2 may be defined by Equation 2:

$$f_2 = \frac{1}{2\pi\sqrt{M_{act} \times C_{act}}} \quad \text{Equation 2}$$

where Ms1 is inertance of the first communicating path, Ms2 is inertance of the second communicating path, Ms3 is inertance of the third communicating path, Mact is inertance of the vibration detector, and Cact is compliance of the vibration detector.

The first to third communicating paths and the vibration detector may satisfy Equation A. By this configuration, it is possible to determine whether the amount of liquid contained in the liquid container is equal to or less than the predetermined amount using a single driving signal, according to a vibration characteristic of the communicating path of the liquid container.

The liquid container may further include an input/output terminal which inputs a driving signal to the vibration detector and outputs the detection signal, and the vibration detector may receive the input driving signal to allow resonance of the vibration portion and output the detection signal having the natural resonance frequency according to vibration of the vibration portion. In this case, it is possible to input the driving signal and output the detection signal via the input/output terminal.

The liquid may be printing ink used for printing, the liquid containing portion may be an ink containing portion, and the liquid container may be an ink cartridge.

In this case, it is possible to determine the amount of ink contained in the ink cartridge.

According to another aspect of the invention, there is provided a printing apparatus including the above-described ink cartridge detachably mounted therein, the printing apparatus including: a mounting portion on which the ink cartridge is mounted; a driving signal output portion which outputs the driving signal to the ink cartridge; a determination portion which determines whether the amount of printing ink contained in the ink containing portion is greater than a predetermined amount, on the basis of the detection signal from the ink cartridge; and a printing portion which executes a printing process using the printing ink contained in the ink cartridge.

According to the printing apparatus, it is possible to determine whether the amount of ink contained in the ink cartridge is equal to or less than the predetermined amount or is greater than the predetermined amount, using one driving signal.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid container according to an embodiment of the invention will be described with reference to the accompanying drawings.

Configuration of Liquid Container

Figure 1:
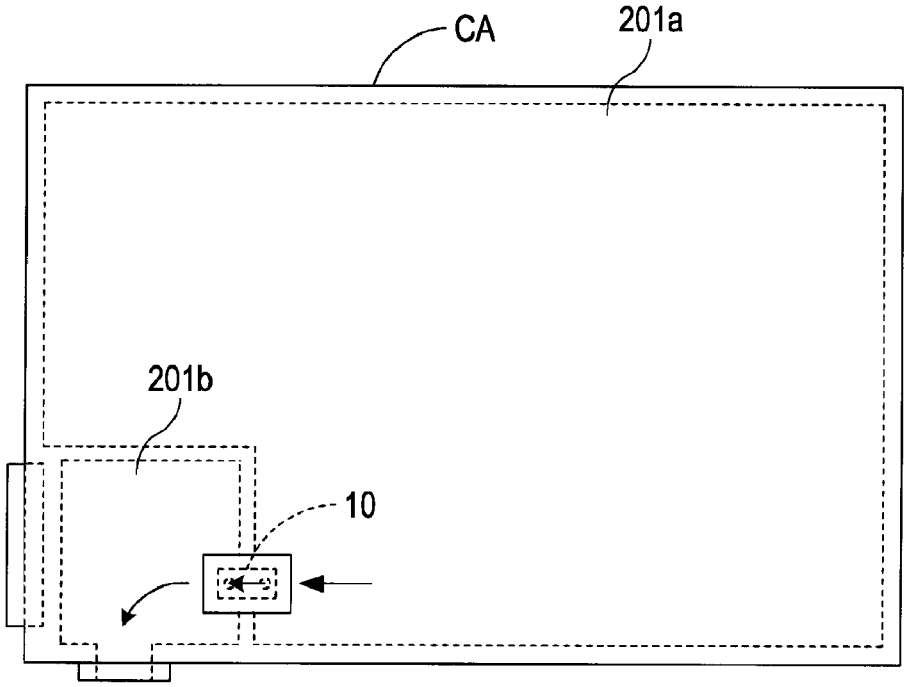
FIG. 1 is a side view showing an ink cartridge according to a first embodiment of the invention.
Figure 2:
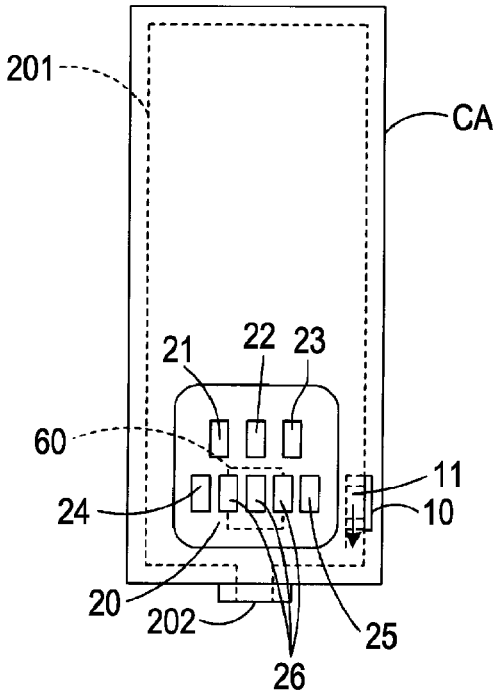
FIG. 2 is a front view showing the ink cartridge according to the first embodiment of the invention.
Figure 3:
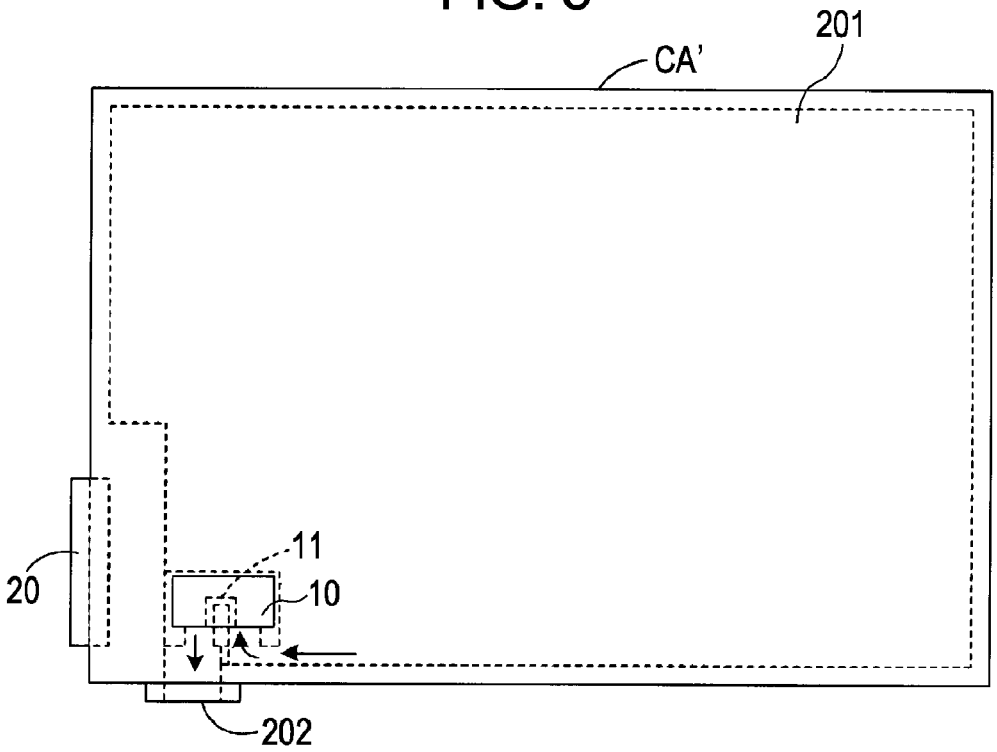
FIG. 3 is a side view showing an ink cartridge according to a second embodiment of the invention.
Figure 4:
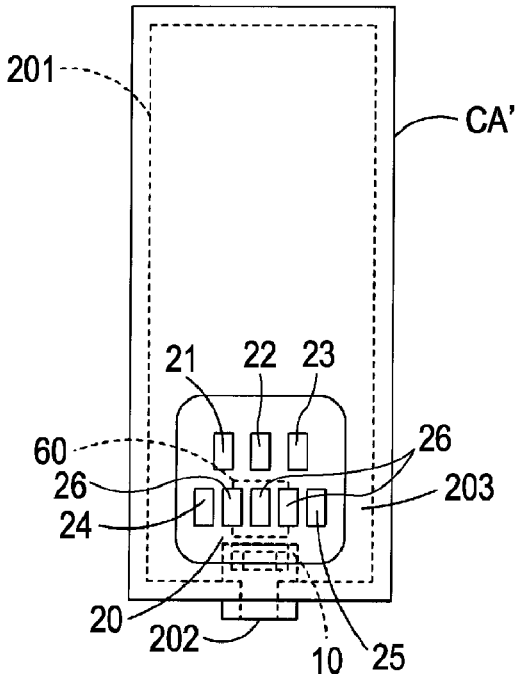
FIG. 4 is a front view showing the ink cartridge according to the second embodiment of the invention.

Hereinafter, in the present embodiments, for example, an ink cartridge which contains ink will be described as a liquid container. The storage of the ink cartridge according to the present embodiments will be described with reference to FIGS. 1 to 4. FIG. 1 is a side view showing an ink cartridge according to a first embodiment of the invention. FIG. 2 is a front view showing the ink cartridge according to the first embodiment of the invention. FIG. 3 is a side view showing an ink cartridge according to a second embodiment of the invention. FIG. 4 is a front view showing the ink cartridge according to the second embodiment of the invention.

Referring to FIGS. 1 and 2, the configuration of the ink cartridge CA according to the first embodiment will be described. In FIGS. 1 and 2, as denoted by dotted lines, the ink cartridge CA according to the first embodiment includes a detection portion 10, a first ink containing portion 201*a*, a second ink containing portion 201*b*, and a substrate 20.

In the ink cartridge CA according to the first embodiment, the detection portion 10 is provided at a side surface of the ink cartridge CA. The detection portion 10 includes a communicating path 11 which communicates the first ink containing portion 201*a* with the second ink containing portion 201*b* and a detector 12 for detecting whether ink is filled in the communicating path 11 or ink is not contained in the communicating path. That is, the detection portion 10 detects whether the ink is filled in the communicating path 11 or the ink is not contained in the communicating path 11 and detects whether the amount of ink contained in the ink cartridge CA is equal to or less than a predetermined amount.

The communicating path 11 is a narrow passage for generating a capillary force and can suppress and prevent air bubbles contained in the first ink containing portion 201*a* and the second ink containing portion 201*b* from penetrating into the communicating path 11. Accordingly, since air bubbles are present in the vicinity of the detector 12 although the ink is sufficiently contained in the first ink containing portion 201*a*, it is possible to suppress or prevent the detector 12 from erroneously detecting that all the ink has been used up (hereinafter, referred to as an "ink end"). When the ink contained in the first ink containing portion 201*a* is used up, a large amount of air bubbles penetrate into the communicating path 11 and thus the detector 12 detects the ink end, as an originally detected result.

If the ink is contained in the first ink containing portion 201*a*, the communicating path 11 is filled with the ink. In contrast, if the ink is not contained in the first ink containing portion 201*a*, and, strictly speaking, if the ink is contained only in the second ink containing portion 201*b*, the communicating path 11 is not filled with the ink. Accordingly, in the present embodiment, the predetermined amount may be an ink storage amount of the second ink containing portion 201*b*. A method of determining whether the ink is contained in the communicating path 11 will be described later.

The detector 12 may be provided to directly contact the ink or may be provided to indirectly contact the ink, for example, through a member for improving a detection characteristic. As the detector 12, a piezoelectric device which is distorted by applying a voltage is used. The detector 12 is electrically connected to a terminal of the substrate 20.

The first ink containing portion 201*a* is a main ink containing portion and the ink storage amount thereof is larger than that of the second ink containing portion 201*b*. The first ink containing portion 201*a* may include an internal pressure adjustment mechanism for adjusting an internal pressure so as to prompt the ink to be supplied into the second ink containing portion 201*b*.

The second ink containing portion 201*b* is an auxiliary ink containing portion and contains a predetermined amount of ink as described above. Accordingly, by appropriately adjusting the ink storage amount of the second ink containing portion 201*b*, it is possible to determine the number of printable pages after it is determined that the ink amount is less than the predetermined amount, that is, after the ink end is detected. In this case, since the predetermined amount of ink remains in the second ink containing portion 201*b* even after the ink end is determined, it is possible to prevent idle driving.

The second ink containing portion 201*b* communicates with an ink supply portion 202 for supplying the ink through an ink supply port included in a printing apparatus. That is, the ink contained in the ink cartridge CA is supplied from the first ink containing portion 201*a* to the printing apparatus through the communicating path 11, the second ink containing portion 201*b* and the ink supply portion 202.

A plurality of terminals 21 to 26 are arranged on the substrate 20. As described below, the terminals 21 to 26 are in contact with a terminal of a carriage circuit of the printing apparatus to be electrically connected to a control circuit. The substrate 20, for example, includes a first cartridge out detection terminal 21, a reference potential terminal 22, a second cartridge out detection terminal 23, a first detector driving terminal 24, a second detector driving terminal 25, and a data terminal 26 as the plurality of terminals.

A configuration of an ink cartridge CA' according to a second embodiment will be described with reference to FIGS. 3 and 4. In FIGS. 3 and 4, as denoted by dotted lines, the ink cartridge CA' according to the second embodiment includes a detection portion 10, an ink containing portion 201 and a substrate 20.

Since the basic configuration of the ink cartridge according to the second embodiment is similar to that of the ink cartridge according to the first embodiment, like components are denoted by the same reference numerals as those of the first embodiment and only the portions different from those of the first embodiment will now be described.

Unlike the ink cartridge CA according to the first embodiment, the second ink cartridge CA' does not include the auxiliary ink containing portion 201*b*.

In the ink cartridge CA' according to the second embodiment, a communicating path 11 communicates the ink containing portion 201 with the ink supply portion 202. In the ink cartridge CA' according to the second embodiment, ink contained in the ink containing portion 201 is supplied to a printing apparatus through the communicating path 11 and the ink supply portion 202.

In the ink cartridge CA' according to the second embodiment, the detection portion 10 is provided in the vicinity of the bottom of the ink cartridge CA' and a detector 12 is provided at the upper surface of the communicating path 11.

Configuration of Detection Portion 10

Figure 5:
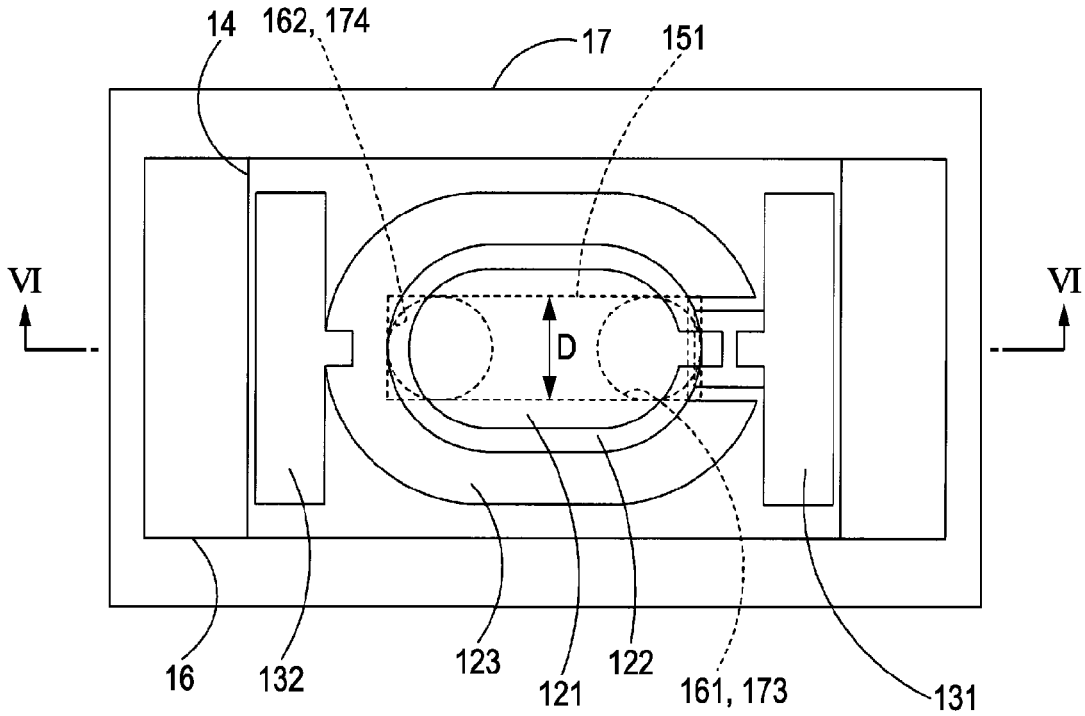
FIG. 5 is a plan view showing a detector used in the present embodiment.
Figure 6:
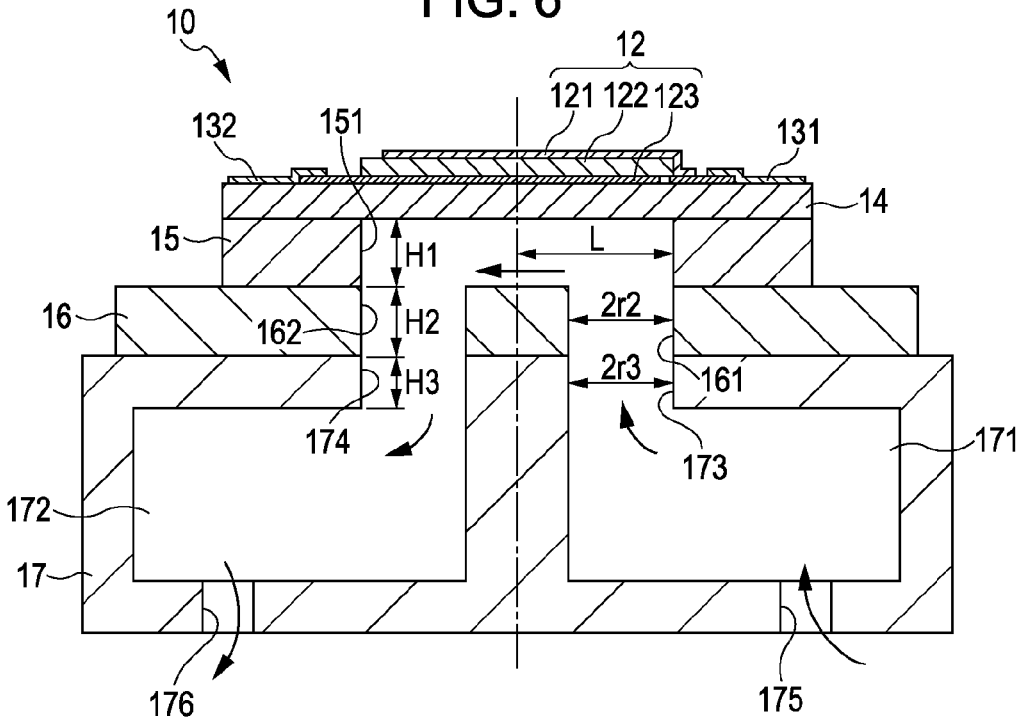
FIG. 6 is a cross-sectional view taken along line VI-VI of the detector used in the present embodiment shown in FIG. 5.
Figure 7:
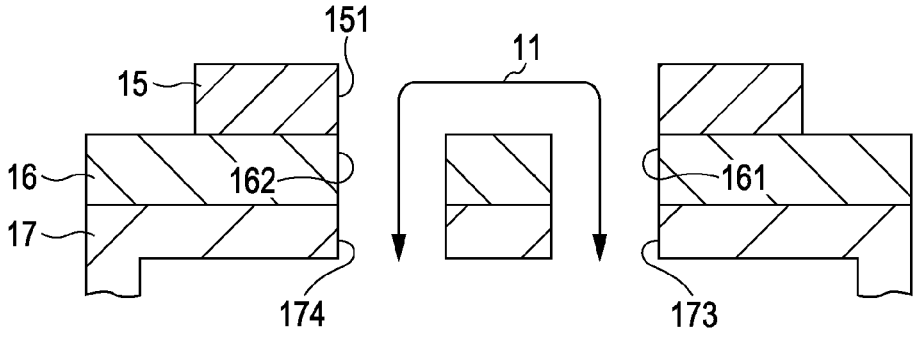
FIG. 7 is a view explaining in detail a communicating path of the detector used in the present embodiment.
Figure 8:
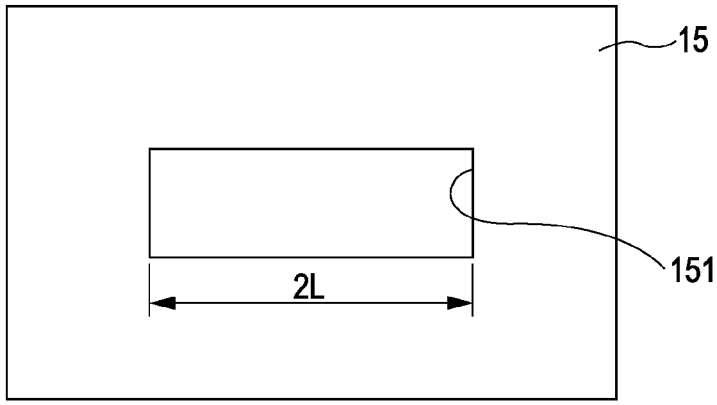
FIG. 8 is a plan view showing a cavity-forming plate configuring the detector used in the present embodiment.
Figure 9:
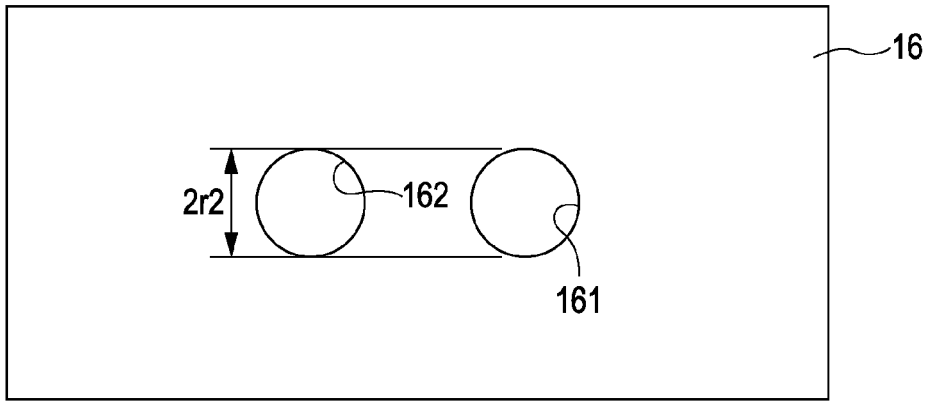
FIG. 9 is a plan view showing a connection-channel-formed plate configuring the detector used in the present embodiment.

The detailed configuration of the detection portion used in the ink cartridge CA according to the present embodiment will be described with reference to FIGS. 5 to 9. FIG. 5 is a plan view showing the detector 12 used in the present embodiment. FIG. 6 is a cross-sectional view taken along line VI-VI of the detector 12 used in the present embodiment shown in FIG. 5. FIG. 7 is a view explaining in detail a communicating path of the detector 12 used in the present embodiment. FIG. 8 is a plan view showing a cavity-forming plate configuring the detector 12 used in the present embodiment. FIG. 9 is a plan view showing a connection-channel-formed plate configuring the detector 12 used in the present embodiment.

The detection portion 10 includes the detector 12, a vibration plate 14, a cavity-forming plate 15, a connection-channel-formed plate 16, and a buffer portion 17. In FIG. 6, the connection-channel-formed plate 16 is provided on the upper surface of the buffer portion 17, the cavity-forming plate 15 is provided on the upper surface of the connection-channel-formed plate 16, the vibration plate 14 is provided on the upper surface of the cavity-forming plate 15, and the detector 12 is provided on the upper surface of the vibrator plate 14. These members are, for example, adhered to each other with an adhesive.

The detection portion 10 includes a cavity 151 formed in the cavity-forming plate 15, a first connection channel 161 and a second connection channel 162, both of which are formed in the connection-channel-formed plate 16, and a supply side buffer chamber 171, a discharge side buffer chamber 172, a buffer supply path 173, a buffer discharge path 174, an ink supply portion 175, and an ink discharge portion 176, all of which are formed in the buffer portion 17, as spaces or channels in which the ink flows. The cavity 151, the first connection channel 161, the second connection channel 162, the buffer supply path 173 and the buffer discharge path 174 configure the communicating path 11 of the present embodiment. The communicating path 11 of the present embodiment is a space which serves as one component for defining a vibration characteristic of a vibration system including the communicating path 11 and the detector 12. These channels have an influence on the vibration characteristic of the vibration system defined by the below-described inertance and compliance.

The detector 12 includes an upper electrode 121, a piezoelectric device body 122, and a lower electrode 123. The piezoelectric device body 122 is inserted between the upper electrode 121 and the lower electrode 123. The surface area of the lower electrode 123 is larger than that of the piezoelectric device body 122 and the surface area of the piezoelectric device body 122 is larger than that of the upper electrode 121.

The piezoelectric device body 122 is a passive device which is distorted (electrostriction) by applying a voltage thereto to output a voltage (counterelectromotive force) according to an external force. As the piezoelectric device body 122, for example, zirconate titanate, lead lanthanum zirconate titanate or a lead-free piezoelectric film may be used.

The detector 12 including the piezoelectric device body 122 functions as both an exciter for supplying excited vibration to the vibration system and a vibration detector for detecting a resonance frequency in the vibration system. In more detail, the detector 12 is subjected to electrostriction by applying a rectangular driving signal thereto and starts excitation vibration by stopping application of a driving signal. The excitation frequency given to the vibration system by the detector 12, that is, the frequency of the driving signal applied to the detector 12, is adjusted to a natural frequency of the vibration system including the detector 12 such that resonance occurs in the vibration system. The detector 12 is distorted by the occurring resonance vibration, that is, detects the vibration, and outputs a voltage value which varies in accordance with the detected vibration, that is, a resonance frequency signal, as a detection result signal.

Since an electrostriction region of the detector 12 is determined by an electrode having a small surface area, the electrostriction region is determined by the upper electrode 121 in the present embodiment. The size of the upper electrode 121 is large enough to cover the piezoelectric device body 122 or is large enough to cover a region from the center of the cavity 151 to the centers of the first and second connection channels 161 and 162. However, in order to prevent a short-circuit between the upper electrode 121 and the lower electrode 123, it is preferable that the upper electrode 121 is smaller than the piezoelectric device body 122.

The upper electrode 121 is electrically connected to a first electrode 131 and the lower electrode 123 is electrically connected to a second electrode 132. As can be seen from FIG. 5, the lower electrode 123 is electrically insulated from the first electrode 131. The first electrode 131 and the second electrode 132 are connected to a first detector driving terminal 24 and a second detector driving terminal 25, respectively. That is, a driving signal is input from an external device, for example, a printing apparatus, to the first detector driving terminal 24 or the second detector driving terminal 25, thereby driving the detector 12.

The vibration plate 14 is a substrate on which components of the detector 12 are mounted and is used to adjust the characteristic of the detector 12 applied to the vibration system. That is, the frequency of the detector 12 can be increased or decreased by varying rigidity realized by the detector 12 and the vibration plate 14.

The cavity-forming plate 15 is a member for forming the cavity 151 and is formed of a metal plate or a resin plate. The cavity 151 formed by the cavity-forming plate 15 has a rectangular shape and dimensions including a width 2L, a depth D, and a height (thickness) H1, as shown in FIGS. 5 and 8. The cavity 151 is a space for collecting the ink when the amount of ink contained in the ink cartridge CA is greater than a predetermined amount and discharging the ink when the amount of ink contained in the ink cartridge CA is less than the predetermined amount. The cavity 15 is a space which directly receives the excitation of the detector 12 and the natural frequency thereof varies according to whether the ink is contained or not. Accordingly, it can be determined whether the amount of ink contained in the ink cartridge CA is less than the predetermined amount, using a difference in natural frequency between the case where the ink is contained and the case where the ink is not contained.

The connection-channel-formed plate 16 is a member for forming the first connection channel 161 and the second connection channel 162 for connecting the cavity-forming plate and the buffer portion 17 and is formed of a metal plate or a resin plate. The first connection channel 161 and the second connection channel 162 each have a cylindrical shape and dimensions including a radius r2 and a height (thickness) H2, as shown in FIGS. 6 and 9. The first connection channel 161 and the second connection channel 162 are used to suppress or prevent air bubbles introduced into the buffer chambers 171 and 172 from flowing into the cavity 151. Accordingly, the first connection channel 161 and the second connection channel 162 have channel sections which are narrow enough to suppress the flow of air bubble.

The buffer portion 17 functions as a cushion portion for suppressing or preventing erroneous detection of the ink end (the amount of ink is less than the predetermined value) due to the fluctuation of ink in the first ink containing portion 201*a*. The supply side buffer chamber 171 of the buffer portion 17 communicates with the first ink containing portion 201*a* via the ink supply portion 175 and communicates with the first connection channel 161 and the cavity 151 via the buffer supply path 173. The discharge side buffer chamber 172 of the buffer portion 17 communicates with the second ink containing portion 201*b* via the ink discharge portion 176 and communicates with the second connection channel 162 and the cavity 151 via the buffer discharge path 174.

When the detection portion 10 is provided below the side surface of the ink cartridge CA and the amount of ink contained in the first ink containing portion 201*a* (or the ink containing portion 201) is larger than the predetermined amount, the communicating path 11 is filled with the ink. When the detection portion 10 is provided below the side surface of the ink cartridge CA and the amount of ink contained in the first ink containing portion 201*a* (or the ink containing portion 201) is equal to or less than the predetermined amount, the communicating path 11 is empty.

When the detection portion 10 is provided on the bottom of the ink cartridge CA' in a vertical state shown in FIG. 6, a liquid level of the supply side buffer chamber 171 varies in accordance with a liquid level of the first ink containing portion 201*a* (or the ink containing portion 201). Accordingly, when the liquid level of the first ink containing portion 201*a* (or the ink containing portion 201) becomes lower than the position of the cavity 151, the cavity 151 is filled with the ink. When the liquid level of the first ink containing portion 201*a* (or the ink containing portion 201) becomes lower than at least the position of the ink supply portion 175, the ink is not contained in the communicating path 11.

Characteristics of Vibration System

Figure 10:
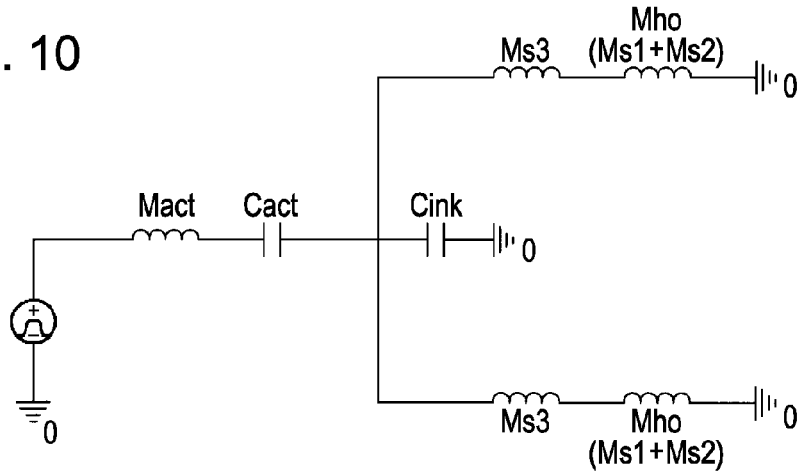
FIG. 10 is an equivalent circuit diagram showing an acoustic circuit of a vibration system according to the present embodiment as an electrical circuit.
Figure 11:
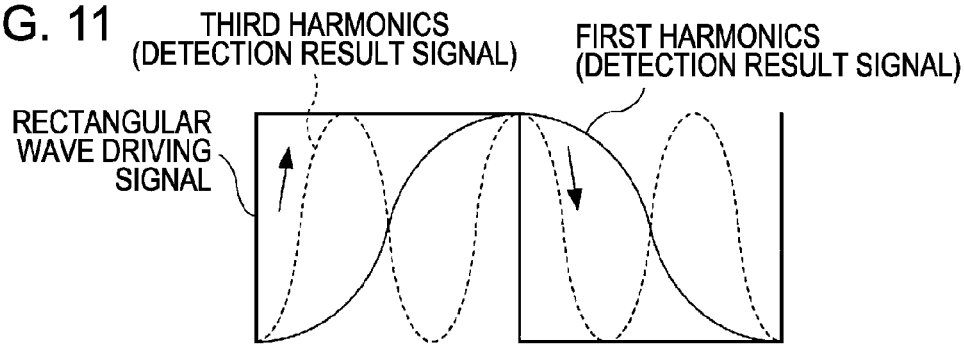
FIG. 11 is a view showing a relationship between the waveform of a driving signal and the waveform of third harmonics.
Figure 12:
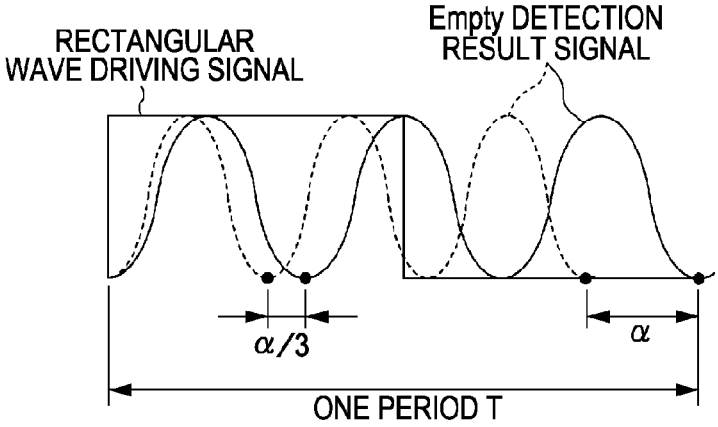
FIG. 12 is a view explaining a waveform margin.

As described above, the cavity 151, the first connection channel 161, the second connection channel 162, the buffer supply path 173 and the buffer discharge path 174 form the communicating path 11 in the present embodiment. In the present embodiment, the vibration system is designed and configured such that a vibration characteristic of the vibration system including the communicating path 11 in which the ink is filled and a vibration characteristic of the vibration system including the communicating path 11 in which the ink is filled has the following relationship. The characteristics of the vibration system will be described with reference to FIGS. 10 to 12. FIG. 10 is an equivalent circuit diagram showing an acoustic circuit of a vibration system according to the present embodiment as an electrical circuit. FIG. 11 is a view showing a relationship between the waveform of a driving signal and the waveform of third harmonics. FIG. 12 is a view explaining a waveform margin.

The vibration system according to the present embodiment includes the communicating path 11 and the detector 12. The acoustic circuit may be considered as an electrical circuit and may be represented by an electrical equivalent circuit. In FIG. 10, the inertances Ms3 and Mho of the communicating path 11 and the inertance Mact of the detector 12 correspond to coils in the electrical circuit and the compliance Ci of the ink and the compliance Cact of the detector 12 correspond to capacitors in the electrical circuit. The supply side buffer chamber 171 and the discharge side buffer chamber 172 correspond to ground in the electrical circuit.

In the vibration system including the circuit configuration shown in FIG. 10, similar to an LC resonance circuit of the electrical circuit, it is possible to obtain a resonance frequency having the inertance M and the acoustic compliance C as parameters, that is a natural resonance frequency. In the communicating path 11, the inertance M is generated by the shape of the communicating path 11 and the compliance C is generated by the ink filled in the communicating path 11.

As the buffer (ground), the compliance of a buffer function portion is at least ten times the compliance Cact of the detector 12 and the inertance of the buffer function portion is 1/10 or less of the inertances Ms3 and Mho of the communicating path 1. The former is a condition for preventing an internal pressure of the buffer function portion from being increased by the vibration of the detector 12 and the latter is a condition for preventing unnecessary vibration from being generated. Strictly speaking, flow resistance is generated in the communicating path 11, but is omitted because flow resistance is unlikely to have influence on vibration simulation of the vibration system.

The compliance Cact of the detector 12 is calculated using a finite element method (FEM). The inertance Mact of the detector 12 can be obtained as an approximate value using the following approximate equation:

$$M_{act} = \frac{1}{4\pi^2} \times \frac{1}{f^2} \times \frac{1}{C_{act}}$$

$$C_{act} = \frac{\Delta V}{P}$$

where f denotes a natural resonance frequency of the detector 12, which can be obtained using the FEM or actual measurement.

The compliance Ci of the ink can be obtained by the following equation:

$$Ci = C \times Vi$$

where C denotes a compression ratio of the ink and Vi denotes the volume of the ink contained in the entire communicating path 11. Since the ink component is mostly water, a compression ratio of water, that is, 4.5e-10/Pa, may be used as the compression ratio of the ink. Since a temperature is unlikely to have influence on the compression ratio, a value of a room temperature (25° C.) is used as the compression ratio of water.

The inertance Ms of the communicating path 11 is obtained by another equation according to the shape of the communicating path 11. In the present embodiment, the cavity 151 has a rectangular parallelepiped shape and the first connection channel 161, the second connection channel 162, the buffer supply path 173 and the buffer discharge path 174 each have a cylindrical shape. The compliance of the communicating path 11 is unlikely to have influence on the vibration simulation of the vibration system and thus will be omitted.

The inertance Ms3 of the cavity 151, that is, the rectangular parallelepiped space, is obtained by the following equation:

$$M_{s3} = \frac{\rho L}{DH1}$$

where ρ denotes a viscosity of the ink, H1 denotes a height of the cavity 151, L denotes ½ of the length of the cavity 151, and D denotes a depth of the cavity 151.

The inertance Mho of the first connection channel 161, the second connection channel 162, the buffer supply path 173 or the buffer discharge path 174 each having the cylindrical shape are by the following equation. The inertance Mho is the sum of the inertance Ms1/ of the first connection channel 161 and the second connection channel 162 and the inertance Ms2 of the buffer supply path 173 and the buffer discharge path 174. If the first connection channel 161, the second connection channel 162, the buffer supply path 173 and the buffer discharge path 174 each have rectangular parallelepiped shape, it goes without saying that the inertance is obtained using the equation applied to the cavity 151. If the cavity 151 has a cylindrical shape, it goes without saying that the inertance is obtained using the following equation used in the first connection channel 161:

$$M_{s1}(M_{s2}) = \frac{\rho H}{\pi r^2}$$

where ρ denotes a viscosity of the ink, H denotes a height (length) of each channel, and r is a cross-sectional radius of each channel. The height H corresponds to H2 in the first connection channel 161 and the second connection channel 162 and corresponds to H3 in the buffer supply path 173 and the buffer discharge path 174. The radius r corresponds to r2 in the first connection channel 161 and the second connection channel 162 and corresponds to r3 in the buffer supply path 173 and the buffer discharge path 174.

When the equivalent circuit shown in FIG. 10 is used, it can be seen that unnecessary vibration does not occur in the detection portion 10 if the inertance of the first connection channel 161, the inertance of the second connection channel 162, the inertance of the buffer supply path 173 and the inertance of the buffer discharge path 174 are substantially the same. Accordingly, in the present embodiment, the communicating path 11 is configured to be symmetrical with respect to a central axis of the cavity 151. That is, the spaces formed by the cavity 151, the first connection channel 161, the second connection channel 162, the buffer supply path 173 and the buffer discharge path 174 are symmetrical with respect to the central axis of the cavity 151.

When the ink is contained in the communicating path 11, that is, when the amount of ink contained in the ink cartridge CA is greater than the predetermined amount, the natural resonance frequency (hereinafter, referred to as a "Full frequency f1") is expressed using the inertance M and the compliance C obtained by the above-described equations as follows.

$$f_1 = \frac{1}{2\pi\sqrt{(M_{act} + M_h + M_{cav}) \times (C_{act} + C_i)}}$$

$$M_h = \frac{M_{ho} \times M_{ho}}{M_{ho} + M_{ho}} = \frac{M_{ho}}{2}$$

$$M_{cav} = \frac{M_{s3}}{2}$$

When the ink is not contained in the communicating path 11, that is, when the amount of ink contained in the ink cartridge CA is equal to or less than the predetermined amount, the natural resonance frequency (hereinafter, referred to as an "Empty frequency f2") is expressed using the inertance M and the compliance C obtained by the above-described equations as follows. In more detail, a term depending on the ink, that is, a term related to the communicating path 11, becomes "0" and thus only a term related to the detector 12 remains.

$$f_2 = \frac{1}{2\pi\sqrt{M_{act} \times C_{act}}}$$

If the Full frequency f1 and the Empty frequency f2 satisfy a relationship of f1=f2/B (Equation 1A), the detection result signal (Full detection result signal) when the amount of ink contained in the ink cartridge CA is greater than the predetermined amount and the detection result signal (Empty detection result signal) when the amount of ink contained in the ink cartridge CA is equal to or less than the predetermined amount can be obtained according to the amount of ink contained in the ink, by a driving signal corresponding to the Full frequency f1. That is, the natural vibration having the Full frequency f1 and the Empty frequency f2 can be excited by one kind of driving signal frequency.

In the relationship, B is any odd number of 3 or less. If B is the odd number of 3 or less, for example, if B=3, as shown in FIG. 11, phases of rising edges and falling edges of the detection result signal (Full detection result signal) of first harmonics and the detection result signal (Empty detection result signal) of third harmonics are matched to a rising edge and a falling edge of the driving signal having the Full frequency and thus efficient resonance can be obtained. In contrast, if B is an even number, a rising edge of even-numbered harmonics corresponds to the falling edge of the driving signal and thus efficient resonance cannot be obtained. Rather, the vibration is rapidly attenuated. As described above, if the Full frequency f1 and the Empty frequency f2 satisfy the relationship of f1=f2/B, the natural vibration having the Full frequency f1 and the Empty frequency f2 can be excited by one kind of driving signal frequency.

The applicant found that sufficient Full detection result signal can be obtained if the Full frequency f1 (natural frequency when the ink amount is greater than the predetermined amount) is in a range of 0.75 times to 1.25 times the driving signal frequency with respect to the driving signal having a predetermined frequency applied to the detection portion 10. That is, if the driving signal of the Full frequency f1 is given to the vibration system having the Full frequency f1 as the natural frequency, it is possible to obtain the detection result signal having sufficient determination precision with respect to a disturbance component such as noise in the range of 0.75 times to 1.25 times the driving signal frequency, that is, the Full frequency f1.

Accordingly, the relationship between the Full frequency f1 and the Empty frequency f2 can be expanded as follows.

$$0.75*f2/B \leqq f1 \leqq 1.25*f2/B \qquad \text{Equation 2A}$$

That is, Full natural frequency F of the vibration system for providing a sufficient detection result signal with respect to the driving signal of the Full frequency f1 is in a range of 0.75*f1≦F≦1.25*f1 (Equation 3A) and the natural frequency F of the vibration system is generally designed to matched to the driving signal frequency. Accordingly, if Equation 1A is substituted into Equation 3A, Equation 2A can be obtained.

When a driving signal having a predetermined frequency is applied to the detection portion 10, a range which can obtain sufficient Full detection result signal and a range which can obtain sufficient Empty detection result signal from the detection portion are different. That is, if the detection result signal having the Full frequency f1 is used, a detectable range of the Empty frequency f2 which can obtain the sufficient detection result signal corresponding to the Empty frequency f2 is ±25/B % of B times the Full frequency f1.

If the detectable range of the Empty frequency f2 is the above-described range, for example, if B=3, a deviation of the Full frequency f1 is evenly allocated to periods of the Empty frequency f2, as shown in FIG. 12. That is, if the period of Empty detection result signal are deviated by (25/3) %, that is, about 8%, the period is deviated by 25% at a timing corresponding to one period T of Full detection result signal (after three periods from the Empty frequency period). The detectable range having a range of ±25% in the Full frequency f1 becomes ±25/B in the Empty frequency f2. The difference between the detectable range of the Full frequency f1 and the detectable range of the Empty frequency f2 is experimentally confirmed by the applicant.

In the present embodiment, the Empty frequency f2 is designed to be higher than B times the Full frequency f1 by 25/B %. The reason why the Empty frequency f2 is designed as described above is because, when the ink of the communicating path 11 is exhausted using the ink cartridge CA, some of the ink is attached to the surface of the vibration plate 14 and thus the Empty frequency f2 is detected to be slightly lower than that at the time of design. By such design, it is experimentally confirmed that the Empty frequency f2 is in the detectable range even when a degree that the Empty frequency f2 is reduced due to the attachment of the ink becomes a maximum. That is, when the Empty frequency f2 is designed to have a maximum value in the detectable range ±25/B % of B times the Full frequency f1, the detection is possible although the Empty frequency f2 is deviated to a low frequency side while the ink cartridge CA is used. In the present embodiment 0.25/B is called a waveform margin of the Empty frequency f2.

The vibration system according to the present embodiment is designed and configured such that the Full frequency f1 and the Empty frequency f2 satisfy the following equation A. That is, with respect to the detector 12 having a predetermined vibration characteristic, three-dimensional sizes of the cavity 151, the first connection channel 161, the second connection channel 162, the buffer supply path 173 and the buffer discharge path 174, all of which configure the communicating path 11, are determined such that the following equation A is satisfied. In the following equation A, since the waveform margin is reduced from the Empty frequency f2, the Full frequency f1 may be about one time of an odd number of Empty frequency f2.

$$0.75*f2(1-0.25/B)/B \leqq f1 \leqq 1.25*f2(1-0.25/B)/B \qquad \text{Equation A}$$

When the vibration characteristic of the vibration system, that is, the detector 12 and the communicating path 11, is set so as to satisfy the above-described condition, it can be detected whether the amount of ink contained in the ink cartridge CA is greater than the predetermined amount and it can be detected whether the amount of ink contained in the ink cartridge CA is equal to or less than the predetermined amount, by one kind of driving signal, that is, the driving signal having the Full frequency f1. In more detail, when Full driving signal is applied to the detection portion 10, it is possible to obtain the Full frequency f1 if the amount of ink contained in the ink cartridge CA is greater than the predetermined amount and it is possible to obtain the Empty frequency f1 if the amount of ink contained in the ink cartridge CA is equal to or less than the predetermined amount.

Printing Apparatus

Figure 13:
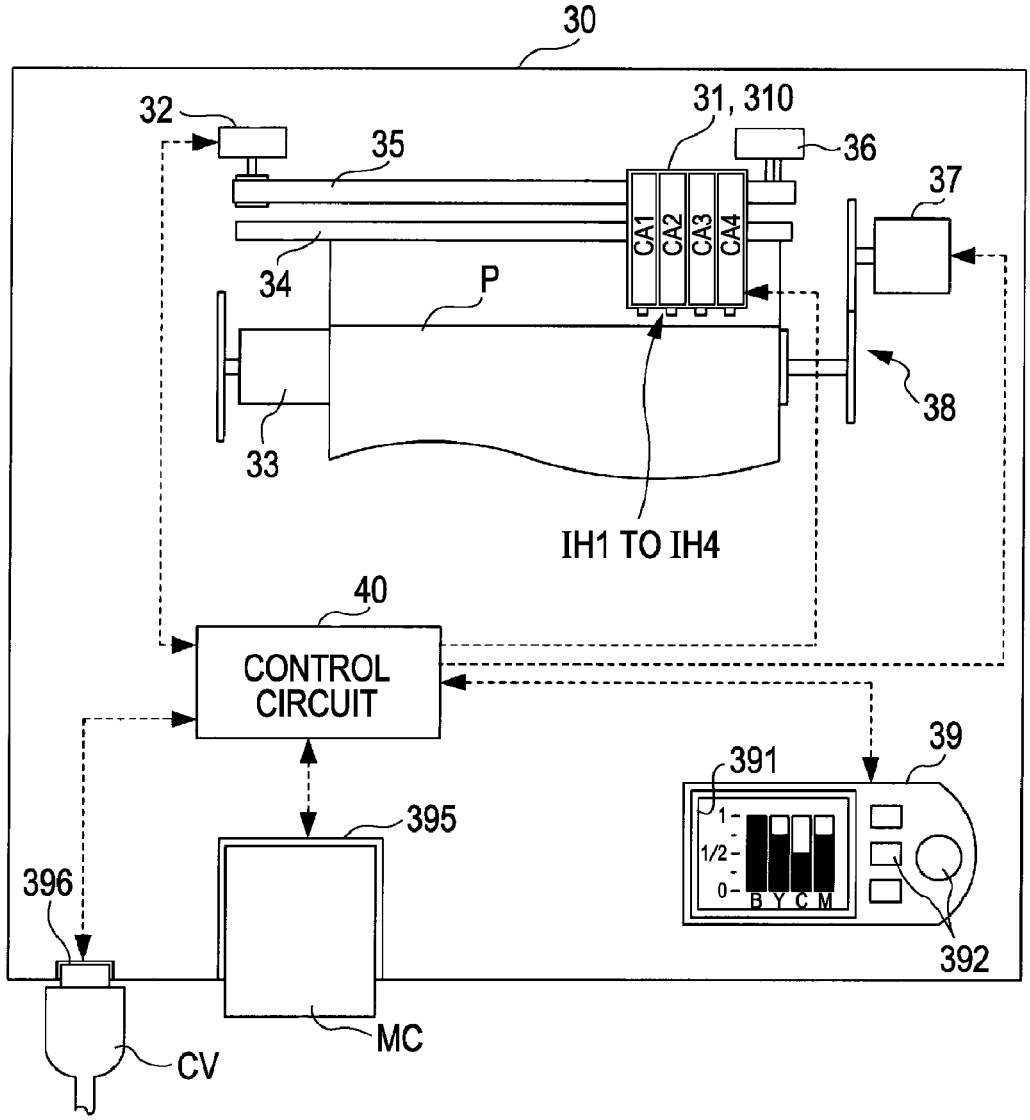
FIG. 13 is a schematic configuration view showing a printing apparatus in which the ink cartridge according to the first or second embodiment is mounted and used.

The configuration of a printing apparatus for applying a driving signal for detecting an ink amount to the ink cartridge CA according to the present embodiment will be described with reference to FIG. 13. FIG. 13 is a schematic configuration view showing a printing apparatus 30 in which the ink cartridge CA according to the present embodiment is mounted and used.

In the present embodiment, for example, the printing apparatus will be described as a liquid consuming apparatus. The printing apparatus 30 includes a main-scanning-direction transport mechanism, a sub-scanning-direction transport mechanism, a print head driving mechanism, and a control circuit for controlling the mechanisms and executing a variety of program function for managing an ink consumption amount of liquid.

The main-scanning-direction transport mechanism includes a carriage motor 32 for driving a carriage 31, a sliding shaft 34 which is installed in parallel with a shaft of a platen 33 and slidably holds the carriage 31, a pulley 36 for stretching an endless driving belt 35 with the carriage motor 32, and a sensor (not shown) for detecting an original position of the carriage 31. The main-scanning-direction transport mechanism reciprocally moves the carriage 31 using the carriage motor 32 in an axial direction (main scanning direction) of the platen 33.

The carriage 31 includes a holder 310, print heads IH1 to IH4, and a carriage circuit 3070. The holder 310 is provided above the print heads IH1 to IH4 such that a plurality of ink cartridges CA1 to CA4 can be mounted thereon. In an example shown in FIG. 13, four ink cartridges CA1 to CA4 are mounted on the holder 310. For example, the ink cartridges CA1 to CA4 in which ink of four colors including black, yellow, magenta and cyan is respectively contained are mounted. The print heads IH1 to IH4 and the ink cartridges CA1 to CA4 respectively communicate with each other via the ink supply portions 202 and ink supply needles (not shown) and the ink contained in the ink cartridges CA1 to CA4 is supplied to the print heads IH1 to IH4 via the ink supply portions 202 and the ink supply needles.

The sub-scanning-direction transport mechanism includes a paper sheet transport motor 37 and a gear train 38. The sub-scanning-direction transport mechanism delivers the rotation of the paper sheet transport motor 37 to the platen 33 via the gear train 38 to transport the print sheet P in a sub scanning direction.

The head driving mechanism drives the print heads IH1 to IH4 mounted on the carriage 31 to control the ink discharge amount and timing such that a desired dot pattern is formed on a print medium. As the ink driving mechanism, for example, a driving mechanism which uses deformation of a piezoelectric device for generating distortion by application of a voltage or a driving mechanism which uses air bubbles generated in the ink using a heater for generating heat by application of a voltage is used.

The control circuit 40 is connected to the carriage motor 32, the paper sheet transport motor 37, the carriage circuit 3070 and a manipulation panel 39 via a signal line. The control circuit 40 is also connected to a memory card slot 395 and an input/output terminal 396 via a signal line to be connected to a computer or a digital still camera via the input/output terminal 396. The control circuit 40 drives the carriage motor 32, the paper sheet transport motor 37, and the print heads IH1 to IH4 according to an instruction of the computer or the manipulation panel 390 or a variety of programs stored in the control circuit 40.

The manipulation panel 39 includes a display panel 391 and a manipulation key 392. The display panel 391 is a color display panel for displaying a variety of information including information on an ink amount or an image by dot matrix display having predetermined resolution. On the display panel 391, the amounts of ink which remains in the ink cartridges CA1 to CA4 are displayed in bar graph shapes and a user interface (software key) for executing a variety of functions relating to the print of the printing apparatus 30 is displayed. The manipulation key 392 is used to select and input desired image data and to input the selection/execution input of the variety of functions to the control circuit 30. When the display panel 391 functions as an input panel, a variety of inputs may be performed via the display panel 391.

Figure 14:
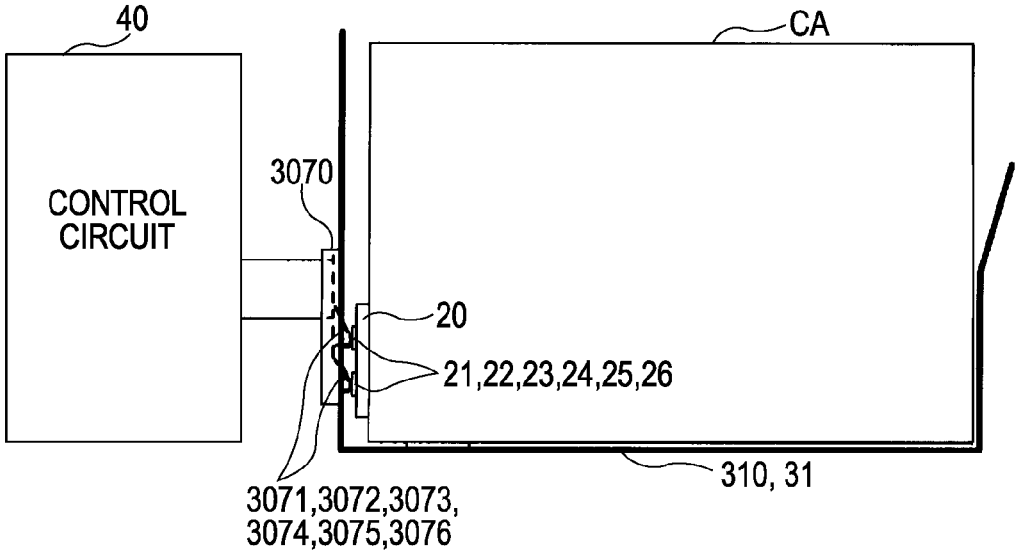
FIG. 14 is a schematic explanation view showing a state that the ink cartridge according to the present embodiment is mounted.
Figure 15:
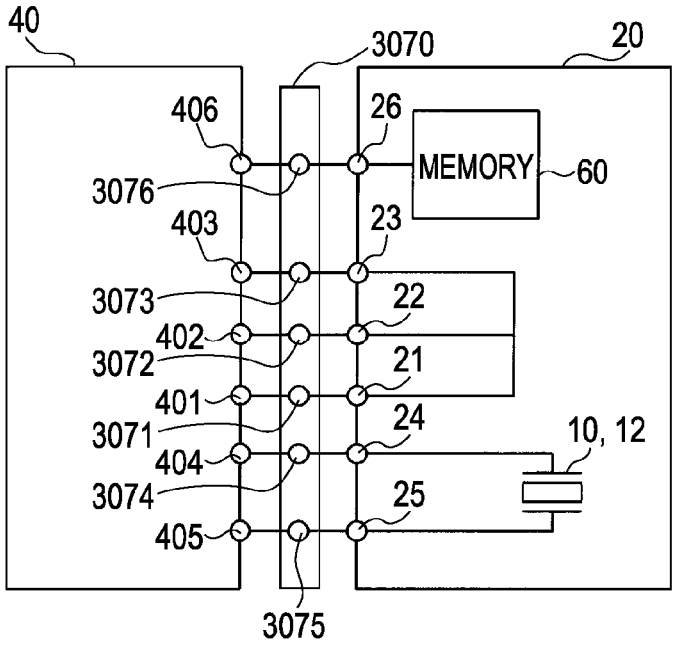
FIG. 15 is an explanation view showing a circuit configuration of terminals of a substrate according to the present embodiment.
Figure 16:
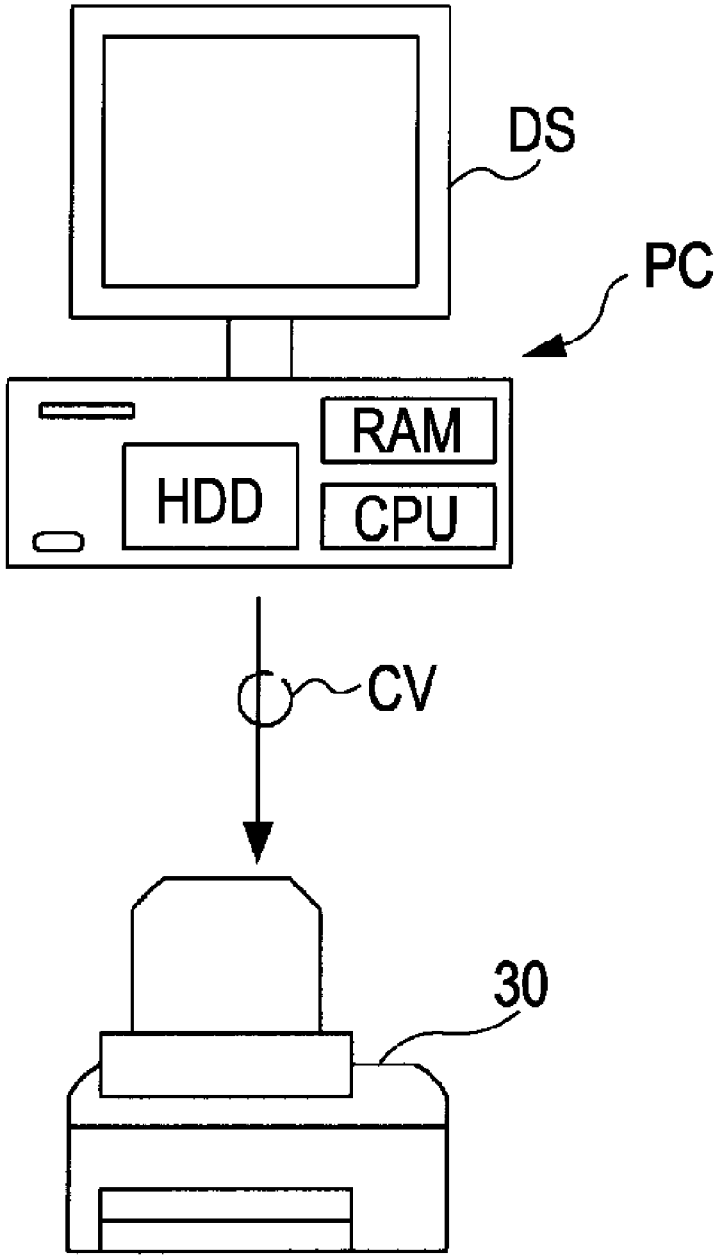
FIG. 16 is an explanation view showing a configuration example of a system in which a personal computer and a printer are connected.

Terminals 21 to 26 mounted on a substrate 20 and the connection between the terminals 21 to 26 of the substrate 20 and the carriage circuit 3070 will be described with reference to FIGS. 14 and 15. FIG. 14 is a schematic explanation view showing a state that the ink cartridge according to the present embodiment is mounted. FIG. 15 is an explanation view showing a circuit configuration of the terminals of the substrate according to the present embodiment.

The carriage circuit 3070 includes contact pins 3071 to 3076 which respectively contact the terminals 21 to 26 of the substrate 20. The contact pins 3071 to 3076 are electrically connected to terminals 401 to 406 of the control circuit 40, respectively. The contact pins 3071 to 3076 may be, for example, a first cartridge out detection pin 3071, a reference potential pin 3072, a second cartridge out detection pin 2073, a first ink end sensor driving pin 3074, a second ink end sensor driving pin 3075, and a data pin 3076. The terminals 401 to 406 of the control circuit 40 may be, for example, a first cartridge out detection terminal 401, a reference potential terminal 402, a second cartridge out detection terminal 403, a first ink end sensor driving terminal 404, a second ink end sensor driving terminal 405, and a data terminal 406.

The front ends of the contact pins 3071 to 3076 are farther from the carriage circuit 3070 than the contact positions between the terminals 21 to 26 of the substrate 20 and the ink cartridge CA when the ink cartridge CA is not mounted. Accordingly, when the ink cartridge CA is mounted on the holder 310 of the carriage 31, the contact pins 3071 to 3076 of the carriage circuit 3070 are biased toward the terminals 21 to 26 of the substrate 20 and the terminals 21 to 26 are electrically connected to the contact pins 3071 to 3076, respectively.

In the substrate 20, the first cartridge out detection terminal 21 and the second cartridge out detection terminal 23 are directly connected to the reference potential terminal 22. The first ink end sensor driving terminal 24 and the second ink end sensor driving terminal 25 are connected to the detector 12. The data terminal 26 is connected to a memory 60.

A driving voltage for driving the detector 12 is input to any one of the first ink end sensor driving terminal 404 and the second ink end sensor driving terminal 405 when it is determined whether the amount of ink contained in the first ink containing portion 201*a* is equal to or less than a predetermined value.

The control circuit 40 supplies the driving voltage to the detector 12 and disconnects the line for supplying the driving voltage, for example, the first ink end sensor driving terminal 404, the ink end sensor driving pin 3074 and the first ink end sensor driving terminal 24 from a driving voltage source. As a result, charges charged in the detector 12 are discharged to vibrate the detector 12. The detection result signal (counter electromotive voltage signal) having a natural resonance frequency of a vibration system excited by the detector 12 is generated in the line for supplying the driving voltage, according to the amount of ink contained in the first ink containing portion 201*a*.

The control circuit 40 measures the frequency of the input detection result signal, that is, the natural resonance frequency of the vibration system, to determine residual amount of ink. As described above, the frequency of the detection result signal indicates the natural frequency of the vibration system including the detector 12, the communicating path 11 and the ink or a structure near the detector 12 and varies according to the amount of ink which remains in the first ink containing portion 201*a*. Accordingly, it can be determined whether a sufficient amount of ink remains in the ink cartridge CA, depending on whether the frequency of the detection result signal is the same frequency as the natural frequency when the ink sufficiently remains in the first ink containing portion 201*a* or the same frequency as the natural frequency when the amount of ink which remains in the first ink containing portion 201*a* is equal to or less than the predetermined amount.

The driving signal used in the present embodiment has a frequency corresponding to the natural resonance frequency of the vibration system when the amount of ink contained in the ink cartridge CA is greater than the predetermined value, that is, when the communicating path 11 is filled with the ink, as described above. The vibration system of the ink cartridge CA in the present embodiment is formed such that the natural resonance frequency (Full frequency) of the vibration system when the communicating path 11 is filled with the ink becomes about 1/odd number of the natural resonance frequency (Empty frequency) of the vibration system when the communicating path 11 is not filled with the ink. That is, the vibration system is formed to satisfy the above-described equation A.

Accordingly, when the driving signal corresponding the Full frequency is input to the first ink end sensor driving terminal 24 or the second ink end sensor driving terminal 25 to stop the application of the driving signal, any one of the Full frequency or the Empty frequency is obtained as the detection result signal. That is, when the amount of ink contained in the ink cartridge CA is greater than the predetermined value, the detection result signal having the Full frequency is obtained and, when the amount of ink contained in the ink cartridge CA is equal to or less than the predetermined value, the detection result signal having the Empty frequency is obtained.

As described above, the ink cartridge CA according to the present embodiment includes a vibration system in which the natural resonance frequency (Full frequency) of the vibration system when the communicating path 11 is filled with the ink becomes about 1/odd number of the natural resonance frequency (Empty frequency) of the vibration system when the communicating path 11 is not filled with the ink. Accordingly, it can be determined whether the amount of ink contained in the ink cartridge CA is equal to or less than the predetermined value or is greater than the predetermined value, using Full driving signal corresponding to the Full frequency.

Since the ink cartridge CA according to the present embodiment considers the waveform margin $\alpha$, it is possible to obtain the detection result signal which can determine whether the amount of ink contained in the ink cartridge CA is equal to or less than the predetermined value or is greater than the predetermined value, although the ink cartridge CA has a product error (tolerance).

Other Embodiments (1) Although the buffer portion 17 and the cavity 151 are connected to each other via the first connection channel 161 and the second connection channel 162 in the embodiments, the first connection channel 161 and the second connection channel 162 may not be included if it is possible to suppress air bubbles from being introduced from the cavity 151 to the buffer portion 17 by a device different from the first connection channel 161 and the second connection channel 162.

(2) Although the buffer supply path 173 and the buffer discharge path 174 are included in the buffer portion 17 and the inertances M of these paths are considered in the embodiments, the inertances M of the paths may be ignored if the diameters of the paths or the heights (thicknesses) of the paths are very small.

(3) The configuration of the communicating path 11 according to the embodiment is only exemplary, a cylindrical shaped path (cylindrical portions) may be further included in addition to the first connection path 161 and the second connection path 162. In this case, it is determined whether the added path has influence on the Full frequency f1 or not, according to a ratio of cross-sectional area of the path to the area of the cavity 151. In general, if the cross-sectional area of the added path is at least four times the area of the area of the cavity 151, the vibration of the added path may be ignored.

(4) Although the printing apparatus 30 includes only the terminals 401 to 406 corresponding to one ink cartridge CA in the embodiments for clarity of description, the terminals 401 to 406 as many as the ink cartridges may be included when a plurality of ink cartridge CA is mounted.

(5) Although, for example, the printing apparatus is described in the embodiments, a personal computer (PC) connected to the printing apparatus 30 via a connection cable CV may execute management of the ink amount which is executed by the print apparatus 30. In this case, the management of the ink amount is executed by a printer driver stored in a hard disc drive (HDD) and an ink residual amount is displayed on a display device (DS) connected to the PC as a portion of a display screen provided by the printer driver. The management of the ink amount according to the present embodiment can be realized by the printer driver or a computer readable medium having the printer driver recorded thereon, such as a CDROM or DVDROM.

(6) Although the ink end is determined by the control circuit 40 in the embodiments, a sensor ink end determination circuit may be included in the ink cartridge CA.

(7) Although the invention applies to the ink cartridge CA and the printing apparatus 30 including the same in the embodiments, the invention is applicable to a liquid consuming apparatus such as a liquid spray apparatus for spraying a coating material or a laminated material contained in a cartridge. Even in this case, it is advantageous in consuming liquid and managing a consumed liquid amount.

Although the invention has been described on the basis of embodiments or modified examples, the embodiments of the invention facilitate the understanding of the invention and the invention is not limited to the embodiments. The invention may be changed or modified without departing from the scope of claims and is included in equivalents thereof.

The entire disclosure of Japanese Patent Application No. 2006-205539, filed Jul. 28, 2006 is expressly incorporated by reference herein.

What is claimed is:

1. A liquid container comprising:

a liquid containing portion for containing liquid; and a detection portion which outputs a detection signal having a frequency f1 of about f1=f2/B, where B is any odd number and where f2 is a frequency of a detection signal output when the amount of liquid contained in the liquid containing portion is equal to or less than a predetermined amount, when the amount of liquid contained in the liquid containing portion is greater than the predetermined amount, wherein the frequency f1 of the detection signal output when the amount of liquid contained in the liquid containing portion is greater than the predetermined amount and the frequency f2 of the detection signal output when the amount of liquid contained in the liquid containing portion is equal to or less than the predetermined amount satisfy Equation A:

$$0.75*f2(1-0.25/B)/B \leqq f1 \leqq 1.25*f2(1-0.25/B)/B \qquad \text{Equation A}$$

(where 0.25/B is a waveform margin and B is an odd number of 3 or less).

2. The liquid container according to claim 1, wherein the detection portion includes:

a communicating path which communicates with the liquid containing portion, is filled with the liquid when the amount of liquid contained in the liquid containing portion is greater than the predetermined amount, and is not filled with the liquid when the amount of liquid contained in the liquid containing portion is equal to or less than the predetermined amount; and a vibration detector which is provided in the communicating path and outputs the detection signal according to detected vibration, wherein a natural resonance frequency of a vibration portion formed by the vibration detector and the communicating path when the communicating path is filled with the liquid is about f1=f2/B, where B is any odd number and where f2 is a frequency of a natural resonance frequency when the communicating path is not filled with the liquid.

3. The liquid container according to claim 2, wherein the natural resonance frequency f1 when the communicating path is filled with the liquid and the natural resonance frequency f2 when the communicating path is not filled with the liquid satisfy Equation A:

$$0.75*f2(1-0.25/B)/B \leqq f1 \leqq 1.25*f2(1-0.25/B)/B \qquad \text{Equation A}$$

(where 0.25/B is a waveform margin and B is an odd number of 3 or less).

4. The liquid container according to claim 3, wherein the natural resonance frequency f1 is defined by Equation 1:

$$f_1 = \frac{1}{2\pi\sqrt{(M_{act} + M_s) \times (C_{act} + C_i)}}, \qquad \text{Equation 1}$$

and wherein the natural resonance frequency f2 is defined by Equation 2:

$$f_2 = \frac{1}{2\pi\sqrt{M_{act} \times C_{act}}} \qquad \text{Equation 2}$$

(where Ms is inertance of the communicating path, Mact is inertance of the vibration detector, and Cact is compliance of the vibration detector), and wherein the communicating path and the vibration detector satisfy Equation A.

5. The liquid container according to claim 2, wherein the liquid containing portion includes a first containing portion and a second containing portion, and wherein the first containing portion and the second containing portion are connected to each other via the communicating path.

6. The liquid container according to claim 5, wherein the communicating path includes a first communicating path which communicates with the first containing portion, a second communicating path which communicates with the second containing portion, and a third communicating path which communicates with the first and second communicating paths and has the vibration detector mounted therein.

7. The liquid container according to claim 6, wherein the natural resonance frequency fl is defined by Equation 3

$$f_1 = \frac{1}{2\pi\sqrt{\left(M_{act} + \frac{M_{s1} \times M_{s2}}{M_{s1} + M_{s2}} + \frac{M_{s3}}{2}\right) \times (C_{act} + C_i)}}, \quad \text{Equation 3}$$

and wherein the natural resonance frequency f2 is defined by Equation 2:

$$f_2 = \frac{1}{2\pi\sqrt{M_{act} \times C_{act}}} \quad \text{Equation 2}$$

(where Ms1 is inertance of the first communicating path, Ms2 is inertance of the second communicating path, Ms3 is inertance of the third communicating path, Mact is inertance of the vibration detector, and Cact is compliance of the vibration detector), and wherein the first to third communicating paths and the vibration detector satisfy Equation A.

8. The liquid container according to claim 2, further comprising an input/output terminal which inputs a driving signal to the vibration detector and outputs the detection signal, wherein the vibration detector receives the input driving signal to allow resonance of the vibration portion and outputs the detection signal having the natural resonance frequency according to vibration of the vibration portion.

9. The liquid container according to claim 1, wherein the liquid is printing ink used for printing, the liquid containing portion is an ink containing portion, and the liquid container is an ink cartridge.

10. A printing apparatus including the ink cartridge according to claim 9 detachably mounted therein, the printing apparatus comprising:

a mounting portion on which the ink cartridge is mounted;

a driving signal output portion which outputs the driving signal to the ink cartridge;

a determination portion which determines whether the amount of printing ink contained in the ink containing portion is greater than a predetermined amount, on the basis of the detection signal from the ink cartridge; and a printing portion which executes a printing process using the printing ink contained in the ink cartridge.

* * * * *